US006807992B2

(12) United States Patent
Powers

(10) Patent No.: US 6,807,992 B2
(45) Date of Patent: Oct. 26, 2004

(54) CONVERTIBLE HANDBAG

(76) Inventor: Donna Marie Powers, 4302 E. 79th St., Tulsa, OK (US) 74136

( * ) Notice: Subject to any disclaimer, the term of this patent is extended or adjusted under 35 U.S.C. 154(b) by 0 days.

(21) Appl. No.: 10/244,940

(22) Filed: Sep. 16, 2002

(65) Prior Publication Data

US 2004/0050468 A1 Mar. 18, 2004

(51) Int. Cl.[7] ..... A45C 13/08
(52) U.S. Cl. ..... 150/105; 150/118
(58) Field of Search ..... 150/103, 107, 150/104, 110, 105, 124, 118, 112, 113; D3/233, 228, 232, 243, 226, 246, 230; 383/42, 29, 43, 78, 93, 8, 11, 13, 15, 28; 140/114, 109

(56) References Cited

U.S. PATENT DOCUMENTS 1,696,138 A * 12/1928 Day et al. ..... 383/103
1,747,801 A * 2/1930 Topal ..... 150/104
2,080,453 A * 5/1937 Kraut ..... 150/104
2,318,563 A * 5/1943 Smith ..... 150/107
2,635,664 A * 4/1953 Cohen ..... 150/103
3,954,128 A * 5/1976 Rushing et al. ..... 150/110
4,112,991 A * 9/1978 Barbaresi ..... 150/104
4,154,323 A * 5/1979 Sneider ..... 383/4
5,955,948 A * 9/1999 Howell ..... 150/101
6,179,025 B1 * 1/2001 Sutton ..... 150/105

* cited by examiner

*Primary Examiner*—Tri M. Mai
(74) *Attorney, Agent, or Firm*—Head, Johnson & Kachigian

(57) ABSTRACT

A handbag that has several flaps attached to the main body, which can be flipped from one side to the other by means of a cross bar attached to the top of each corner of said handbag, in order to change the color and appearance of the front or back sidewall to coordinate the handbag with the outfit being worn at the time.

6 Claims, 5 Drawing Sheets

CONVERTIBLE HANDBAG

The present invention is a convertible handbag, which allows the owner to change the color or pattern of the handbag quickly and easily in order to match any outfit being worn. The body of the handbag is a basic "lunch bag" style with a front, back, left and right sidewalls, a lining, and a bottom. The open top is slightly covered with a snap on flap in order to prevent any contents from failing out. The shoulder strap is attached to the top of each end wall. The front and back walls have matching reinforced holes in the top left and right hand corners. There are two matching crossbars secured to the handbag, one on each upper corner. The crossbars are secured to the handbag by threaded ends of each bar being fitted through front and back reinforced holes in the handbag and secured on the inside of the handbag with decorative nuts.

Before securing the cross bars to the handbag, they are threaded through matching reinforced holes in the upper left and upper right band corners of one or more flaps. Each flap consists of two pieces of material of different color or design secured back to back with a reinforced material in between to make it rigid and is completed with a trim around the perimeter. Each flap is the same dimension of the front and back wall of the handbag.

Once the cross bars are threaded through the extra flaps and attached to the handbag, the flaps can easily be flipped up over the crossbars to the other side to display the chosen color or pattern. Different colors or patterns can be displayed simply by turning the handbag around, and/or by flipping the flaps over to the other side.

BACKGROUND OF THE INVENTION

This invention relates to a convertible handbag, which allows one to quickly and easily change the color of the handbag simply turning the handbag around or by moving a flap or flaps from one side to the other by means of a crossbar at the top of each side of the handbag, in order to coordinate the bag with the outfit being worn and not having to change handbags.

As we all know, it is very important for a woman to have a matching, attractive and functional handbag, whether it be for work or for play. Most women spend a great deal of money buying many different handbags just for this purpose, along with much time and effort changing the contents from one handbag to another. This invention saves both time and money, which in today's hectic society, is very important.

There have been many attempts to create such a handbag, but each has left much room for improvement. One example of prior art is U.S. Pat. No. 1,747,801. This patent discloses a handbag with removable closure flaps that are retained by press button snaps in a pocket in the rear of the purse. The current invention is better than this one because you do not have to remove the flaps to display a different color and therefore there is no chance of losing them. The current invention is also much faster way to change the look of the handbag.

Another attempt to make a changeable handbag is U.S. Pat. No. 2,798,524. This patent discloses a handbag with a cover flap, which has one end affixed to the bottom of the bag and completely wraps around both sides and the top of the bag. This handbag can only display a few colors at a time. The current invention surpasses this one by being able to display 6 or more changes in color or design without having to change out a flap.

Another attempt at a convertible handbag is U.S. Pat. No. 4,027,710. This patent describes a handbag, which has a plurality of facing members secured to the bottom of the handbag and can be moved to cover one sidewall or the other and is secured by a clasp keeping them in place. The current invention is much better in that the flaps flip over the top of the handbag and do not need a clasp to keep them in place.

Another attempt is seen in U.S. Pat. No. 5,503,204. This patent describes a handbag which has interchangeable removable flaps which are selectively attached to the handbag by a spring-loaded toggle lock and hasp system. The current invention is superior to this one in that it can have more flaps attached at one time and because of the ease of moving the flaps from one side to the other.

All of the above prior patents disclose handbags which can change the outer appearance, but each is complicated and has many steps involved in the change and only have a few colors to choose from. The present invention much different and is a much needed improvement over all of the above mentioned attempts due to it's features which allow a much simpler, quicker and easier transformation of the handbag with just one flip. The current invention also allows many changes without the possibility of losing any part of the handbag since all parts are attached to the handbag.

| | | | |
|---|---|---|---|
| 1747801 | February 1930 | Topal | 150/104 |
| 2798524 | July 1957 | Ryon | 150/103 |
| 4027710 | June 1977 | Keebler | 150/103 |
| 5503204 | April 1996 | Byers | 150/105 |

BRIEF SUMMARY OF THE INVENTION

The present invention relates to an improved handbag system, which combines a basic handbag with many extra flaps, which come in varying materials, colors and designs. The front of the basic handbag is one color or design, while the back and sides are a different color or design. The handbag will embody 2 or more flaps at a time, depending on materials used. Each flap is comprised of a front and a back, each of a different color or design. This enables the owner to display one of many colors or designs just by turning the handbag around or by flipping one or more flaps over the top of the handbag by means of two crossbars. The crossbars are attached to the handbag by the threaded ends placed through reinforced holes in the top corners of the front and back sidewalls and secured on the inside of the handbag by decorative nuts. The flaps are secured to the handbag by the cross bars, again being threaded through reinforced holes in the upper left and right hand corners, before the bars are attached to the handbag. Although it is not required, the crossbars can easily be removed in order to remove the flaps and replace them with more flaps, which can be purchased separately. The flaps are available in many different materials, colors and designs along with custom requests.

DETAILED DESCRIPTION OF THE INVENTION

Figure 1:
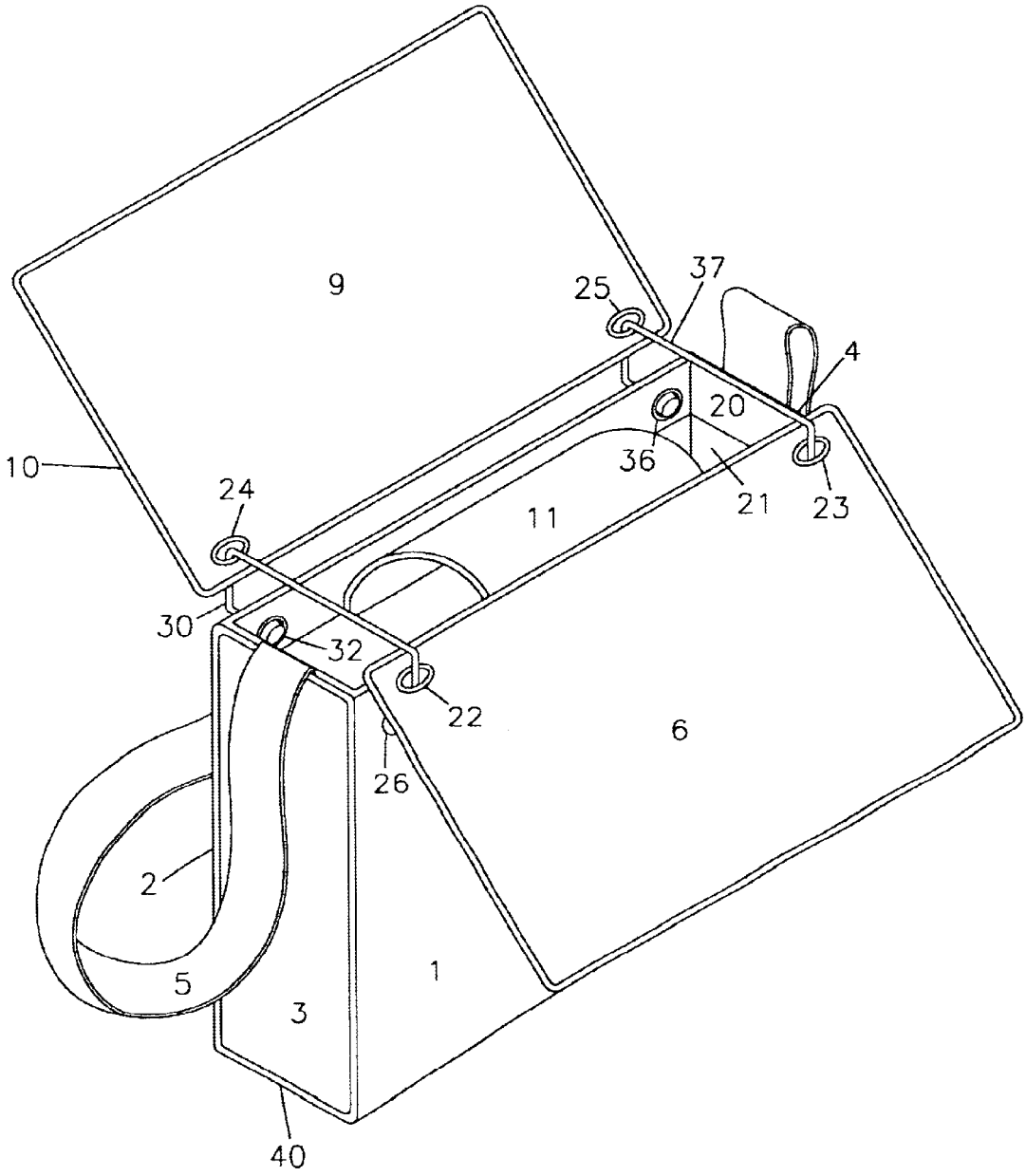
FIG. 1 is a perspective view of the whole handbag with all parts attached and showing movement of flaps.
Figure 2:
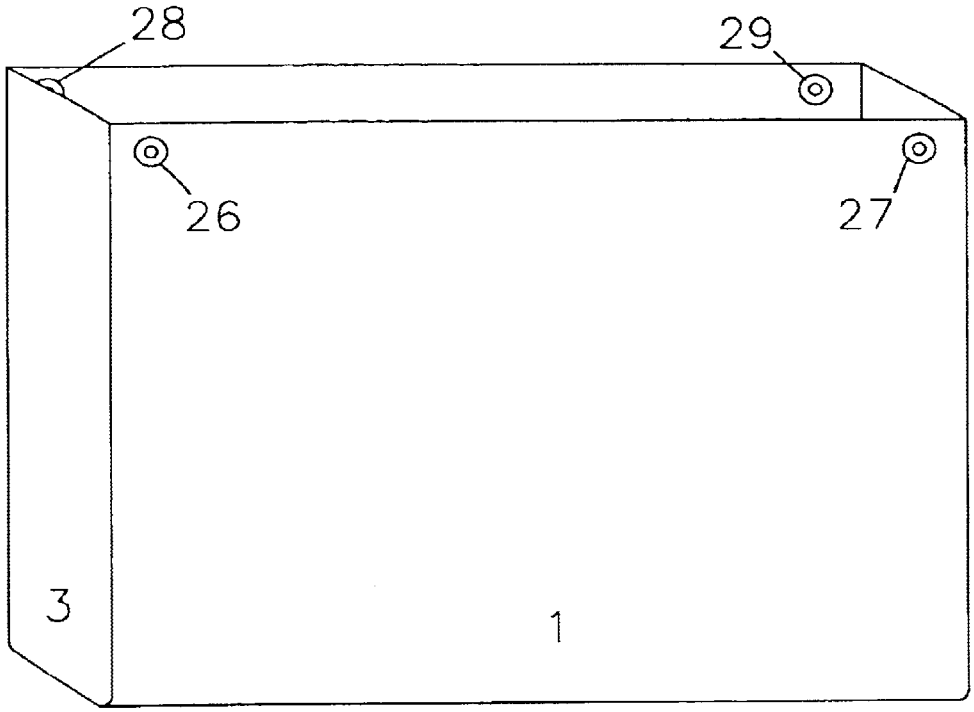
FIG. 2 is a view of the basic handbag with no attachments.
Figure 3:
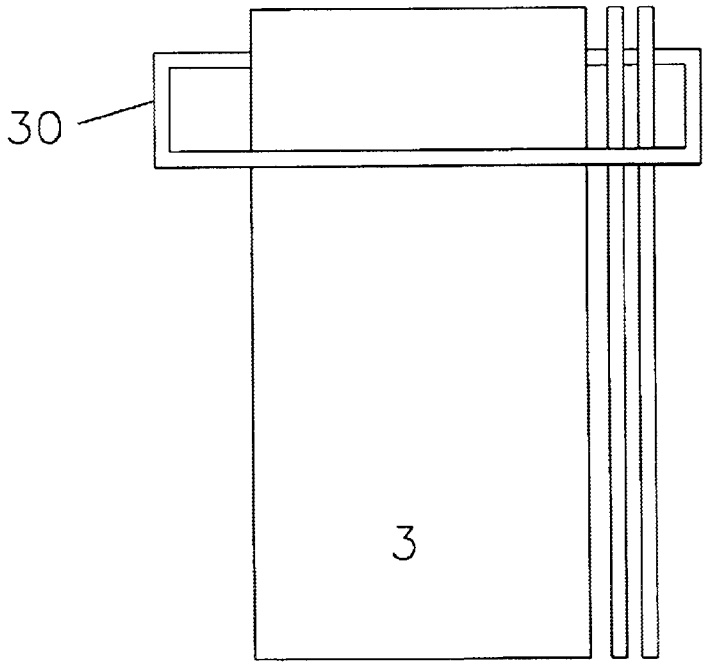
FIG. 3 is an end view of the handbag shown in FIG. 1, with the crossbar in resting position, and both flaps resting on the front sidewall of the handbag.

Referring to the drawing in detail wherein numerals designate elements throughout the various figures, there is shown in FIG. 1, a perspective view of the whole handbag with all parts attached. The basic handbag includes front sidewall 1, back sidewall 2, vertical end wall 3, vertical end wall 4, and bottom 40 which comprise the outside shell of the handbag. Facing 20 and lining 21 comprise the basic inside shell of the completed handbag. Strap 5 is secured at vertical end wall 3 and vertical end wall 4 when basic inside shell and basic outside shell are joined. (Throughout the remainder of the description, facing 20, lining 21 and front sidewall 1 have been combined, therefore designated only as front sidewall 1. Facing 20, lining 21 and back sidewall 2 have been combined, therefore designated only as back sidewall 2.) Affixed to front sidewall 1 in upper left corner and upper right corner are reinforced hole 26 and reinforced hole 27 respectively. Affixed to back sidewall 2 in upper left corner and upper right corners are reinforced holes 28 and 29 respectively, these are better shown in FIG. 2. To view details of a vertical end wall of completed handbag see FIG. 3.

Figure 6:
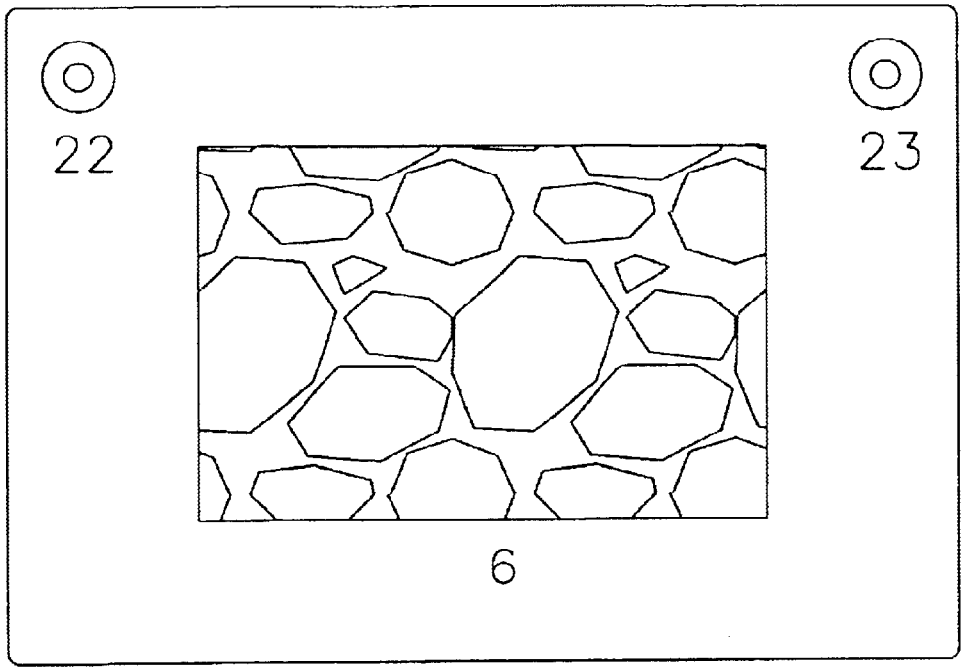
FIG. 6 is a view of one example of the front side of a decorative detachable flap.
Figure 7:
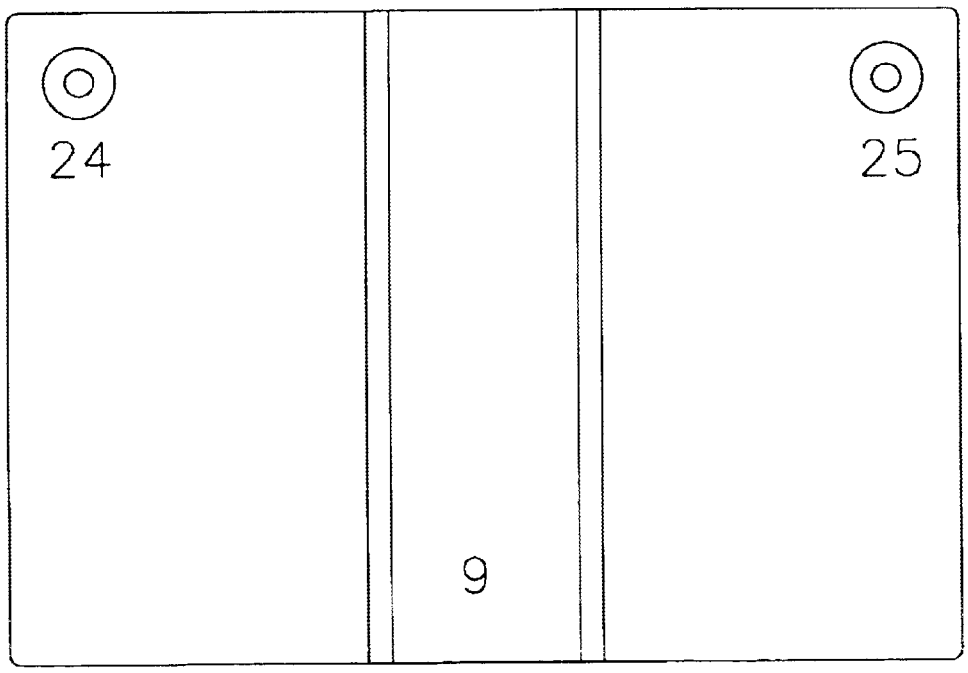
FIG. 7 is a view of one example of the back side of a decorative detachable flap.

The extra flaps in FIG. 1 allow quick and easy transformation of color, design and or texture. One of the flaps incorporates front 6 and back 7 joined back to back. Decorative trim 10 is affixed to outer edge of joined front 6 and back 7. With front 6 and back 7 of decorative flap joined, reinforced hole 22 and reinforced hole 23 are placed in upper left corner and upper right corner respectively. The other decorative flap incorporates front 8 and back 9. With front 8 and back 9 joined, reinforced hole 24 and reinforced hole 25 is placed in upper left corner and upper right corner respectively. See FIGS. 6 and 7 to view an example of the front and back view of a decorative flap.

As seen in FIG. 1 left crossbar 30 and right crossbar 37 (for a detailed view, see FIGS. 8 and 9.) allow a plurality of flaps to "flip" from one side of the handbag over the top to the other side of the handbag, therefore changing the color, design and or texture of the handbag. Threads 31 of left back crossbar 30 are fed through reinforced hole 28 on back sidewall 2 and secured with nut 32 on inside top of handbag. (Nut detail see FIG. 8) Left front crossbar 30 is secured to front sidewall 1 by thread 34 through reinforced hole 22 on first flap, and reinforced hole 24 on second flap and then through reinforced hole 26 on front sidewall 1 and secured with nut 33 on inside top of handbag. Threads 35 of right back crossbar 37 are fed through reinforced hole 29 on back sidewall 2 and secured with nut 36 on inside top of handbag. Right front crossbar 37 is secured to front sidewall 1 by thread 39 through reinforced hole 23 on first flap, through reinforced hole 25 on second flap and through reinforced hole 27 on front sidewall 1 and secured with nut 38 on inside top of handbag. Each flap can then be moved from one side to the other by reinforced holes 22, 23, 24 and 25 gliding across crossbars 30 and 37.

Figure 4:
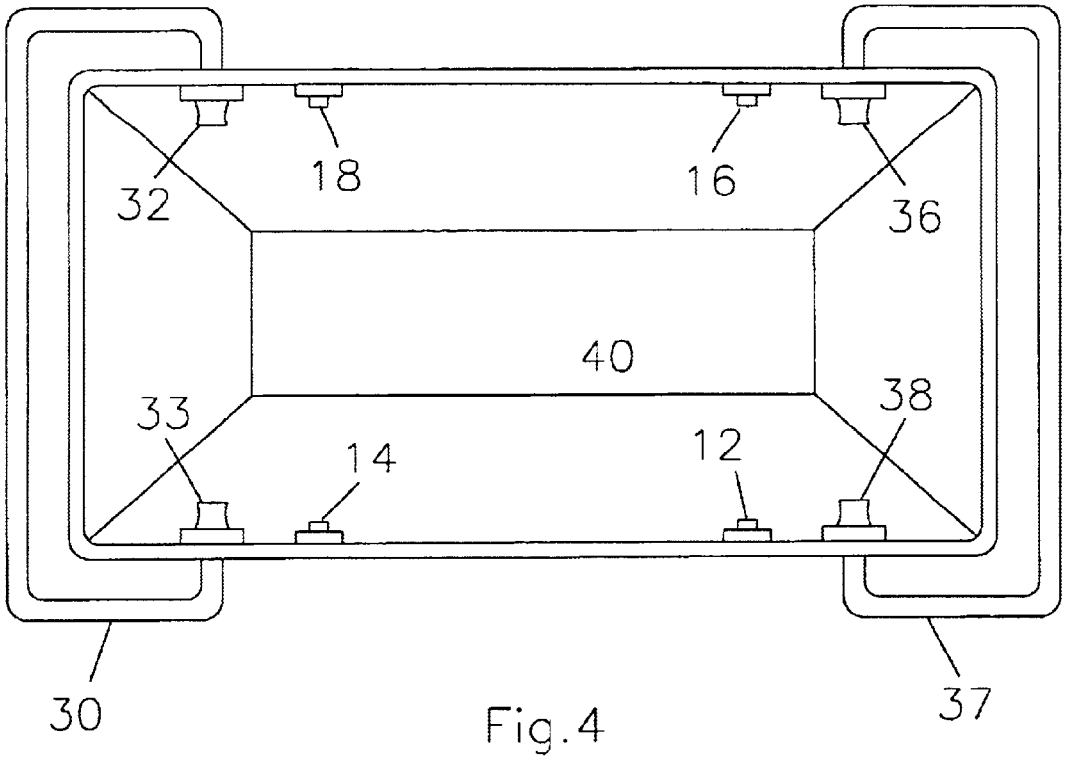
FIG. 4 is an enlarged detailed view of the handbag, looking down into the top of the handbag without security flap attached.
Figure 5:
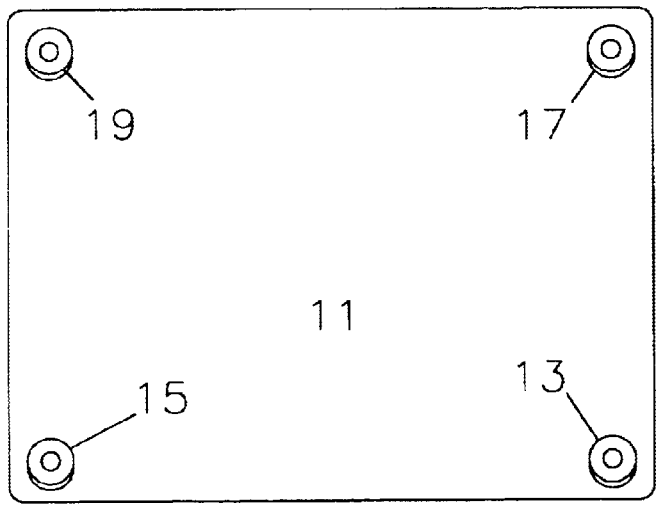
FIG. 5 is a view of the security flap.

Security flap 11 consists of coordinating materials to somewhat cover the top opening of the handbag. Security flap 11 is secured to inside sidewall 1 and inside sidewall 2 with four male magnetic snaps, 13, 15, 17 and 19 which are attached to opposite corners of security flap 11 top. For a detailed view see FIG. 5. Shown in FIG. 4 the corresponding female magnetic snaps 12 and 14 are centered on upper inside front sidewall 1 and female magnetic snaps 16 and 18 are centered on upper inside back sidewall 2. Male magnetic snaps 13 and 15 are then attached to female magnetic snaps 12 and 14 respectively, while male magnetic snaps 17 and 19 are attached to female magnetic snaps 16 and 18 respectively in order to secure flap 11 in place. FIG. 1 shows flap 11 attached and in place.

Figure 8:
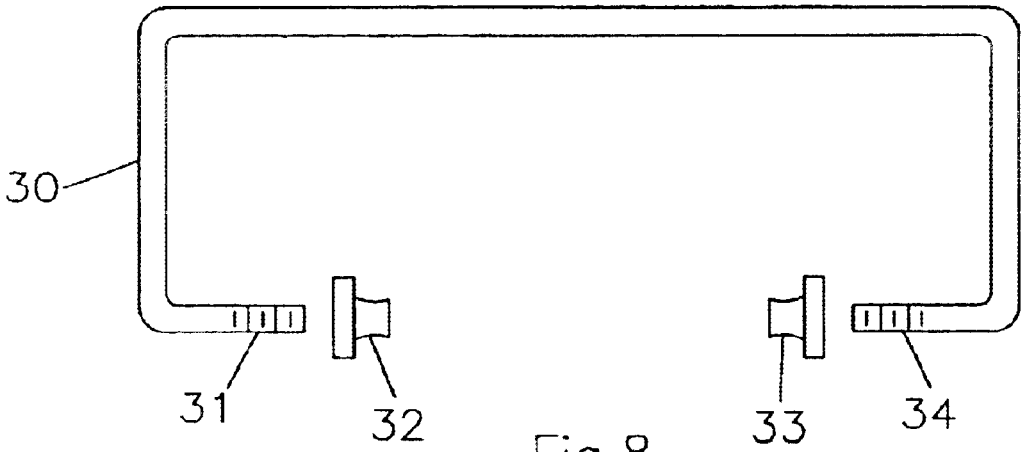
FIG. 8 is an enlarged detailed view of one example of a required left crossbar.
Figure 9:
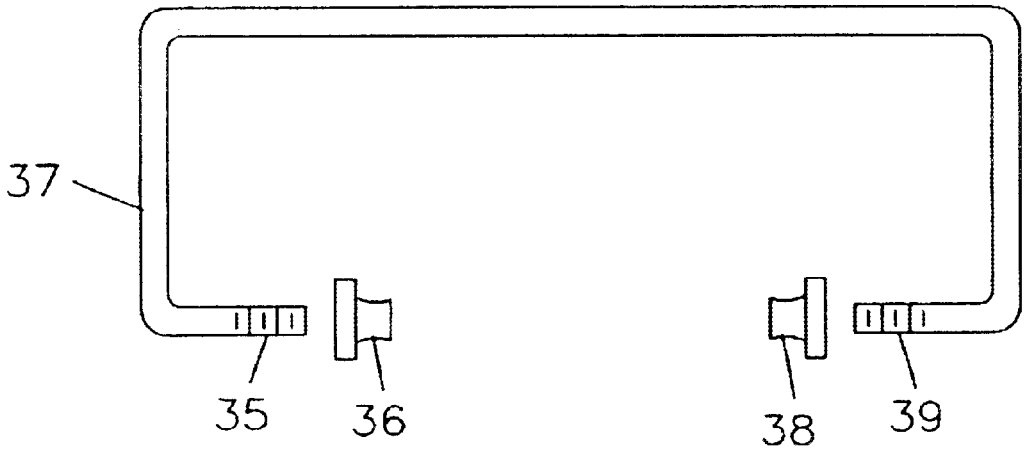
FIG. 9 is an enlarged detailed view of one example of a required right crossbar.

As described in FIG. 1, the crossbar construction allows the handbag numerous transformations by gliding a variety of flaps over left crossbar 30 and right crossbar 37. FIG. 8 is one example of a crossbar shape, the rectangle. Shapes can also include oval and D-ring among others, and can be coated or uncoated with different types of overlay. A determined distance from back and front opening edges, threads 31 and 34 are machined to accompany a screw on nut 32 and 33 to secure crossbars to handbag. Each handbag requires two crossbars of equal size, shape, color and style. Therefore, right crossbar 37 will be an identical twin to left crossbar 30.

I claim:

1. A convertible handbag comprising:

an open topped body having opposed front and back sidewalls, each sidewall having an upper left hand hole and an upper right hand hole;

at least one flap, each said flap being substantially similar in size to said sidewalls, each said flap having an upper left hole and an upper right hole; and a pair of crossbars, each said crossbar having a pair of opposed threaded ends and a nut engaging each end, one said crossbar passing through said flap right hole and said body right hole and another said crossbar passing through said flap left hole and said body left hole.

2. A convertible handbag as set forth in claim 1 wherein said body includes a pair of opposed vertical ends, a bottom, and a lining.

3. A convertible handbag as set forth in claim 1 including a plurality of said flaps.

4. A convertible handbag as set forth in claim 1 including a security flap removably secured to said body.

5. A convertible handbag as set forth in claim 4 wherein said security flap is secured to said body by a plurality of magnetic snaps.

6. A convertible as set forth in claim 1 including a shoulder strap extending from said body.

* * * * *